United States Patent [19]

Langner

[11] Patent Number: 4,540,037

[45] Date of Patent: Sep. 10, 1985

[54] METHOD AND APPARATUS FOR BIDIRECTIONAL HORIZONTAL CONTINUOUS CASING

[75] Inventor: Carl Langner, Monsey, N.Y.

[73] Assignee: Concast AG, Zurich, Switzerland

[21] Appl. No.: 425,120

[22] Filed: Sep. 27, 1982

[51] Int. Cl.[3] ..... B22D 11/04; B22D 11/10; B22D 11/12; B22D 27/02

[52] U.S. Cl. ..... 164/466; 164/263; 164/415; 164/416; 164/420; 164/440; 164/460; 164/472; 164/475; 164/477; 164/478; 164/490; 164/502

[58] Field of Search ..... 164/416, 420, 440, 490, 164/478, 488, 263, 415, 460, 472, 475, 477, 502

[56] References Cited

U.S. PATENT DOCUMENTS

| | | | |
|---|---|---|---|
| 3,472,309 | 10/1969 | Calderon | 164/440 X |
| 3,987,840 | 10/1976 | Birat | 164/490 X |
| 4,146,078 | 3/1979 | Rummel et al. | 164/467 |

FOREIGN PATENT DOCUMENTS

| | | |
|---|---|---|
| 407630 | 4/1974 | U.S.S.R. . |
| 578155 | 1/1978 | U.S.S.R. . |

*Primary Examiner*—Kuang Y. Lin
*Assistant Examiner*—J. Reed Batten, Jr.
*Attorney, Agent, or Firm*—Werner W. Kleeman

[57] ABSTRACT

A molten metal stream is fed downwardly, especially essentially vertically, into a double-ended, chilled horizontal mold where the molten metal is formed into two strands which are cooled and simultaneously bidirectionally withdrawn from opposed ends of the horizontal mold. The infed hot molten metal stream is deposited within the double-ended horizontal mold such that a so-to-speak hot wall forms at the immediate vicinity of the inflow region where the molten metal enters the horizontal mold. This hot wall precludes formation of a strand shell or skin which otherwise would undesirably interconnect the two formed strands, so that not only is the resistance to mold oscillation decreased, but the individual strands can be cleanly withdrawn from each side of the mold without the danger of undesired and uncontrolled interaction arising between the two withdrawn strands and without the need to have to rupture any such interconnecting strand shell or skin. A simple construction of bidirectional horizontal mold contemplates providing a mold inlet opening through which an immersible pouring tube extends from a separate tundish into the internal space of the double-ended horizontal mold, beneath the molten bath level or meniscus, such as to form the hot wall, escape of molten metal out of the inlet opening being precluded by the use of an electromagnetic seal which not only constrains the escape of metal but also may contribute to preventing undesirable strand shell formation at the inflow region of the molten metal to the mold.

41 Claims, 12 Drawing Figures

METHOD AND APPARATUS FOR BIDIRECTIONAL HORIZONTAL CONTINUOUS CASING

BACKGROUND OF THE INVENTION

The present invention relates to the field of continuous casting of metals, particularly steel, including but not limited to steel alloys, and, more specifically, concerns a new and improved method and apparatus for horizontal continuous casting.

Horizontal continuous casting techniques are enjoying increasing interest in the continuous casting art. Normally the horizontal mold is oscillated in order to obtain a disturbance-free withdrawal of the strand and to realize a satisfactory surface quality of the casting. Between the oscillating mold and the forwardly arranged, stationary tundish from which the molten metal is laterally introduced into the horizontal mold, it is therefore necessary to provide an intermediate space which allows such mold oscillation. However, this transition region between the tundish and the mold is difficult to seal and also poses metallurgical problems.

One possibility of overcoming the need to provide an intermediate space between the tundish and the mold would be to physically connect the tundish with the mold. Still a relatively complex seal would have to be provided at the region where the tundish is connected with the mold. Even so, large masses would have to be placed into oscillating motion, and accordingly, complex and energy-consuming drives would have to be provided for conjointly oscillatingly moving the tundish and mold.

Therefore, in U.S. Pat. No. 4,146,078, granted Mar. 27, 1979 a continuous horizontal casting machine has been disclosed which no longer requires the tundish and mold to be conjointly oscillated. Here, the mold is not attached to the tundish. The liquid metal stream flows horizontally from the stationary tundish into the continuous casting mold through a coil which produces a magnetic field for constricting and confining the molten metal along a defined path of travel as it moves in transit between the exit end of the tundish and the inlet end of the continuous casting mold. With this design, on the one hand, there is safeguarded against any deleterious solidification of the molten metal at the outlet or exit opening of the tundish, and, on the other hand, there is compensated the metallostatic pressure at the intermediate gap between the tundish and the mold. That construction of continuous casting installation only casts a single strand.

The use of an electrical conductor powered by a source of alternating-current for repelling molten metal from an opening, such as the inlet opening of a vertical continuous casting mold, in conjunction with a syphon, is known from U.S. Pat. No. 4,020,890, granted May 3, 1977. However, horizontal continuous casting techniques using a double-ended oscillating horizontal mold are neither taught nor contemplated and the provision of the syphon, specifically the plate-like discharge portion which reposes in or near the level of the molten metal within the vertical casting mold itself contributes to the escape of metal from the mold.

Another prior art method and apparatus for continuously casting metals has been disclosed in U.S. Pat. No. 3,472,309, granted Oct. 14, 1969. There is taught the use of a double-ended oscillating mold of inverted T-shaped configuration which is designed to provide at the vertically extending portion of the mold a reservoir equipped with electrical coils for heating the molten metal infed to such upstanding reservoir by a nozzle in order to make-up the heat losses. The lower end of the vertically extending heated reservoir communicates with two copper chill molds from which there are withdrawn two partially solidified strands in opposite direction. This construction of continuous casting machine requires a complicated T-shaped vertical mold formed of different materials and constituting a considerable mass which must be oscillated. Also, special heating facilities must be provided at the refractory reservoir to keep the molten metal in a heated condition until it can reach the two chill molds where the metal is actually cast into two oppositely withdrawn strands. Moreover, with this prior art construction there arise other drawbacks, especially in terms of the extremely difficult accessibility into the mold and impaired visual inspection possibility for the interior of the mold, as well as the increased metallostatic pressure due to the considerable column of molten metal which is present in the vertical reservoir portion of the mold and so forth. Additionally, such mold construction composed of two metallic horizontal mold portions or chill molds and a vertical reservoir portion composed of refractory material is extremely prone to disturbance and complicated in design. To counteract the danger of freezing of the metal there must be installed in the upstanding vertical refractory portion or reservoir the heating coils.

Also, in U.S. Pat. No. 3,575,230, granted Apr. 20, 1971 there is disclosed a similar inverted T-shaped double-ended continuous casting mold having an upstanding heated reservoir, wherein the same shortcomings are essentially present as discussed above with respect to U.S. Pat. No. 3,472,309.

While in Russian Pat. No. 407,630, dated Apr. 19, 1974 there is disclosed a double-ended horizontal continuous casting mold which does not use such a complicated mold design, and specifically only employs an essentially horizontally extending mold, such construction, however, is not an oscillating mold. The molten metal is introduced from above by a pouring nozzle into the non-oscillating horizontal mold and the two formed strands are withdrawn at opposed ends of the mold in opposite directions. To improve the efficiency and the quality of the formed cast strands it is contemplated to horizontally move the pouring nozzle for the influxing metal jet in the direction of the greater rate of strand withdrawal and at a rate equal to the difference in the rates of withdrawal of the metal strands from opposite ends of the continuous casting mold. The two formed strands are interconnected by a strand shell or skin which, upon withdrawal of the two strands from the continuous casting mold, will be unpredictably severed at a random location. Additionally, it is difficult to exactly control the movement of the nozzle infeeding the metal jet so that at all times uniform conditions prevail within the continuous casting mold. Therefore, it is not possible to produce any uniformly cast strands, particularly since the formation of the strand shell along the circumference of the interconnected two strands is disturbed because of the irregular solidification of the cast strands. Hence, reliable casting of strands with this equipment does not appear to be possible.

In Russian Pat. No. 578,155, dated Jan. 13, 1978 there is disclosed a double-ended non-oscillating continuous casting mold which is formed of both a straight mold portion and a curved mold portion. A pouring nozzle infeeds the molten metal from above into the curved portion of the continuous casting mold, and at the opposed ends of the continuous casting mold the two strands are withdrawn. Through the provision of this relatively complicated mold construction, composed of the differently configured mold portions, it is intended to fix at a predetermined place the rupture or fracture location between both of the oppositely withdrawn strands which move along strand axes inclined with respect to the horizontal. This rupture location is intended to be located at the transition region between the straight and curved mold portions, since at that place there is supposed to be located the weakest, hottest and thinnest portion of the continuously cast strands. If this location were situated in the linear mold portion then such part of the strand could not enter into the curved mold portion. The same undesirable phenomenon would arise if the mentioned location were located in the curved portion of the continuous casting mold. Such type of semi-radial continuous casting installation does not allow for the system to operate reliably since a continuous rupture of the strands occurs. Moreover, uniform solidification conditions for the strands cannot be realized with such casting machine. Since this construction of double-ended mold cannot be oscillated for the reasons explained, there is also not possible any withdrawal of the strands out of the continuous casting mold without danger of damaging the same.

SUMMARY OF THE INVENTION

Therefore, with the foregoing in mind it is a primary object of the present invention to provide a new and improved method of, and apparatus for, continuously horizontally casting strands in a manner not associated with the aforementioned drawbacks and limitations of the prior art proposals.

Another and more specific object of the present invention is directed to a new and improved method of, and apparatus for, the continuous horizontal casting of strands at a relatively high casting speed and with large throughput.

Yet a further significant object of the present invention is directed to a new and improved method of, and apparatus for, the continuous horizontal casting of strands by means of a double-ended, horizontal, oscillating continuous casting mold which is of relatively simple design, wherein novel means are provided for precluding the undesirable growth of an interconnecting strand shell or skin between the two cast strands, so that the strands can be simultaneously and independently bidirectionally withdrawn from the mold without the withdrawal of one strand adversely affecting the other withdrawn strand.

Still a further significant object of the present invention is directed to a novel construction of continuous casting machine employing a simplified construction of double-ended, oscillating, horizontal continuous casting mold which enables the tundish to directly infeed the molten metal vertically by means of an immersible pouring tube into a defined region of the casting mold, so that there can be formed a common imaginary hot wall at an interface between the two strands formed therein, this hot wall precluding the formation of an interconnecting strand shell or skin between the continuously cast strands so that the strands can be reliably independently withdrawn at opposed ends of the continuous casting mold without there occurring any undesirable interaction between the two cast strands.

A further important object of the present invention is directed to a new and improved construction of continuous casting machine employing a novel construction of double-ended, oscillating continous casting mold, wherein the mold inlet or infeed opening for the molten metal received from a supply vessel, such as typically as tundish, contains an electromagnetic seal which not only serves to seal such inlet opening against the undesired efflux of molten metal, but further can exert a beneficial constricting action upon the molten metal at least at such region of the inlet opening in order to contribute to inhibiting formation of an undesirable interconnecting strand shell or skin between the bidirectionally withdrawn horizontally cast strands.

Another noteworthy object of the present invention is directed to a new and improved construction of bidirectional horizontal continuous casting apparatus and a method for performing bidirectional horizontal continuous casting, wherein the casting operation can be performed with a relatively simple construction of double-ended oscillating, horizontal, continous casting mold possessing relatively low weight, so that less complicated and simpler drives can be used for oscillating the continous casting mold, the tundish can be arranged separately from the continuous casting mold, thereby obviating the need for conjointly oscillating the tundish and the mold, and the formation of the continuously cast strands in the casting mold is controlled such that the strands can be mutually independently withdrawn from the mold.

A still further important object of the present invention is directed to a new and improved method of, and apparatus for, horizontally continuously casting strands, wherein large quantities of metal per unit of time can be economically and effectively cast into strands possessing good surface qualities, and wherein, in particular, the difficulties which heretofore were present at the transition region between the supply vessel, typically the tundish, and the oscillating horizontal continuous casting mold, can be reliably overcome.

Yet a further important object of the present invention is directed to a continuous casting installation containing means which become positively and reliably effective in the event of metal break-out for reducing the quantity of outflowing metal to a minimum and effectively shutting-off the undesired metal outflow.

Now in order to implement these and still further objects of the invention, which will become more readily apparent as the description proceeds, the horizontal continuous casting method of the present development, according to its more general aspects, is manifested by the features that a molten metal stream is essentially vertically introduced from above into a double-ended horizontal cooled mold, the molten metal is cooled and simultaneously formed therein into at least two strands which are withdrawn essentially horizontally in opposite directions. Importantly, at the immediate or direct inflow region of the molten metal into the mold there is precluded the formation of a strand shell along the mold walls. As stated, this strand shell or skin would otherwise undesirably interconnect the two strands formed in the continuous casting mold.

Introduction of the molten metal from its supply reservoir, typically a tundish, directly into the continuous casting mold, at a location constituting an interface region between the two cast strands which are withdrawn horizontally, is preferably accomplished through the use of an immersible refractory pouring tube which is located relative to the mold walls such that there is precluded the formation of any undesirable strand shell or skin which would otherwise interconnect the two cast strands. The pouring tube is positioned such that at such interface there is formed a so-to-speak common hot wall where sufficient heat is located to inhibit the formation of any interconnecting strand shell or skin between the two cast strands. The pouring tube may be provided with plural metal discharge or outflow openings from which issue the metal jets with an intensity and temperature sufficient to effectively form the common hot wall at the interface between the formed strands. One such jet may be directed downwardly towards the bottom mold wall located opposite the mold inlet opening, thereby generating sufficient heat thereat to counteract any tendency for a strand shell to form.

In the context of this disclosure the direct or immediate inflow or infeed region of the molten metal into the mold is considered to approximately constitute that, for instance, substantially disk-shaped portion or section of the mold extending transversely to the mold lengthwise axis, where the metal infed below the molten bath level of the mold, emerges out of the pouring tube or the like and extends approximately—viewed in the strand withdrawal direction—up to a region shortly after the start of the upper mold wall. Consequently, hot metal, which is still at a sufficiently high temperature above its liquidus temperature flows against the mold walls at the interface region between the two cast strands with a sufficient thermal and flow intensity so as to prevent solidification of the molten metal at such mold walls. In other words, there is beneficially formed the aforementioned common hot wall and there is precluded strand shell formation along the circumference of the strand section located in a substantially vertical plane at such direct inflow region.

Accordingly, the cast strands can be desirably simultaneously independently withdrawn from the oscillating horizontal casting mold in opposite directions without there occurring rupture or tearing of any interconnecting strand shell or skin. The withdrawal speed of both strands can be the same, or else can vary and can be selected to be totally independent of one another.

According to a further aspect of the invention, it is possible to prevent or at least minimize the likelihood of the formation of the strand shell at the direct inflow region of the molten metal into the continuous casting mold by generating an electromagnetic field which preferably extends circumferentially about the continuous casting mold at such direct inflow region of the molten metal into the mold. This electromagnetic field, which may be generated by an electromagnetic coil or coils, tends to constrict or bundle the molten metal within the mold at the region of the imaginary hot wall, so that the metal does not come into contact with the mold walls at such location. A further benefit which can be realized with this aspect of the invention is that, the lift-off of the molten metal from the mold walls provides at least one opening or depression into which there can be introduced in any suitable fashion appropriate additives, such as lubricants, for instance a casting powder, aluminium wire, liquid nitrogen or an inert gas or the like.

Also, it is contemplated according to the invention to confine the molten metal within the hollow mold cavities or compartments of the continuous casting mold and to prevent escape thereof through the mold inlet opening receiving the immersible pouring tube by providing an electromagnetic sealing device. This electromagnetic sealing device or seal beneficially acts upon the meniscus of the molten metal within the continuous casting mold and urges the same downwardly away from the mold inlet opening, so that during mold oscillation the molten metal does not tend to splash out of such mold inlet opening. The action of the electromagnetic seal also can desirably contribute to retarding the formation of an interconnecting strand shell at the location of the mold inlet opening, since the downwardly exerted electromagnetic forces acting upon the meniscus of the molten metal tend to agitate and constrict the latter.

It is also possible to counteract the metallostatic pressure caused by the body of molten metal, not only by means of the magnetic field which acts upon the molten metal, but also by introducing a closed gas shroud formed by a pressurized inert gas which envelops and acts upon the liquid metal within the continuous casting mold at the region of the hot wall, or by a combination of both such measures.

Not only is the invention concerned with the aforementioned method aspects, but as alluded to above also relates to a novel bidirectional horizontal continuous casting apparatus which, according to the invention, contains a horizontal straight oscillating mold having a substantially vertical mold inlet opening for receiving molten metal and two opposite hand mold cavities or compartments for simultaneously forming therein two independent cast strands. The vertical mold opening is substantially flush with the upper wall of the continuous casting mold and of a size to permit both reception of the immersible refractory pouring tube attached to the bottom portion of the metal supply reservoir, typically the tundish, while still allowing for desired mold oscillation. The pouring tube has a discharge end or portion which extends towards the lower mold wall opposite the upper mold wall, so that at the region of discharge of the molten metal from the pouring tube, i.e. at the direct metal inflow region there is advantageously formed the common imaginary hot wall which effectively precludes the growth of any interconnecting strand shell or skin between the two cast strands.

According to the invention the immersible pouring tube may contain at its discharge end, located at the vicinity of the hot wall, namely at the region of the interface between the two cast strands, one or a number of outlet openings from which issue the metal jet or jets of the molten metal received from the tundish via the immersible pouring tube. One such outlet opening is advantageously directed towards the bottom mold wall and other such outlet openings may be directed towards the mold side walls and, if desired, also axially in the direction of the bidirectional withdrawal of the cast strands. It is advantageous during the casting of wide slabs to have the molten metal flow out of the immersible pouring tube through a number of outlet or discharge openings onto the wide sides of the mold, and the issuing molten jets can efflux at different angles with respect to the horizontal. Furthermore, both strand withdrawal units responsible for outfeed of the strands from the mold cound be, depending upon requirements, completely synchronized or have independent strand withdrawal speeds.

The aforementioned electromagnetic seal for sealing the mold inlet opening can be either located essentially only at the region of the mold inlet opening or, if desired, can extend circumferentially about the mold. In the second case the electromagnetic coil or coils exerts a constricting or "pinch effect" upon the molten metal at the region of the vertical plane containing the hot wall, so that the molten metal is somewhat forced away from the mold wall or walls, which advantageously both counteracts against the formation of an undesired interconnecting strand shell and forms one or more pockets or depressions for introducing suitable additives.

A mold oscillator assembly is provided for the purpose of oscillating the double-ended horizontal continuous casting mold and such may comprise, for instance, a mold table upon which there is supported the continuous casting mold. The mold table is equipped with an eccentric drive mechanism and horizontal guides for the purpose of imparting the requisite oscillatory movement to the continuous casting mold.

Additionally, according to the invention the equipment may be provided with shutoff devices for reducing to a minimum the amount of lost liquid metal in the event of a dangerous metal break-out. To that end, conventional metal break-out detectors may be provided which actuate suitable shutoff elements, such as two oppositely situated anvils or plungers or the like, which sealingly press together two opposite walls of the cast strand, or there may be provided four anvils or plungers or the like fusingly pressing together all four walls of the strand.

Another possibility for cutting-off the undesired flow of metal out of the cast strand is to use two blades which move toward the central axis of the cast strand, such blades first welding together or fusing shut the opposite, for instance lower and upper walls of the cast strand, and then subsequently severing-off the strand.

An additional shutoff arrangement contemplates lifting the mold assembly and portions of the strand guide arrangement, for instance roller aprons, and secondary cooling means substantially vertically into an elevational position high enough to prevent the flow of liquid metal from one side to the other, or else there can be provided pinch rolls which press against two opposite sides of the strand and clamp shut or fuse the cast strand.

The use of a freestanding tundish permits multiple strand casting operations to be accomplished, and also there is now possible long sequence casting and continuous-continuous casting operations. While the invention can be used to continuously cast billets, blooms and slabs, it can be employed to particular advantage in the production of large blooms and slabs. Since one mold oscillator assembly serves at least two strands there is also realized a major simplification in the design of horizontal continuous casting machines.

It is also within the teachings of the invention to provide a number of juxtapositioned continuous casting molds. These plural molds then can be charged from a forwardly arranged common tundish by means of a plurality of immersible refractory pouring tubes, so that there is realized a multi-strand casting installation wherein a multiplicity of adjacently arranged strands can be withdrawn horizontally and in opposite withdrawal directions. This affords the advantage that there can be provided common guide elements or withdrawal machines for a number of adjacently situated strand lines.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
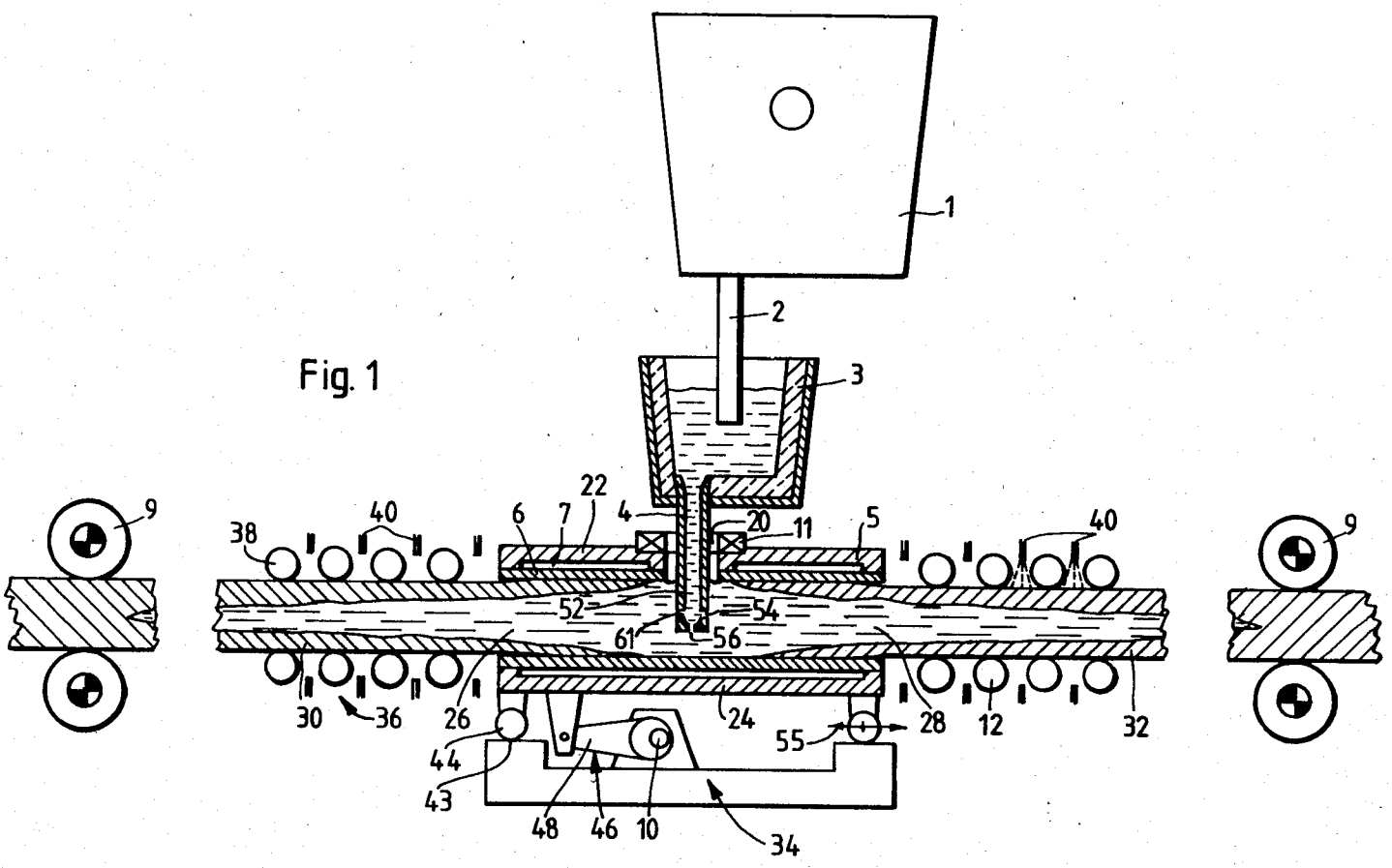
FIG. 1 is an elevational view schematically illustrating an exemplary embodiment of horizontal continuous casting apparatus according to the invention.
Figure 2:
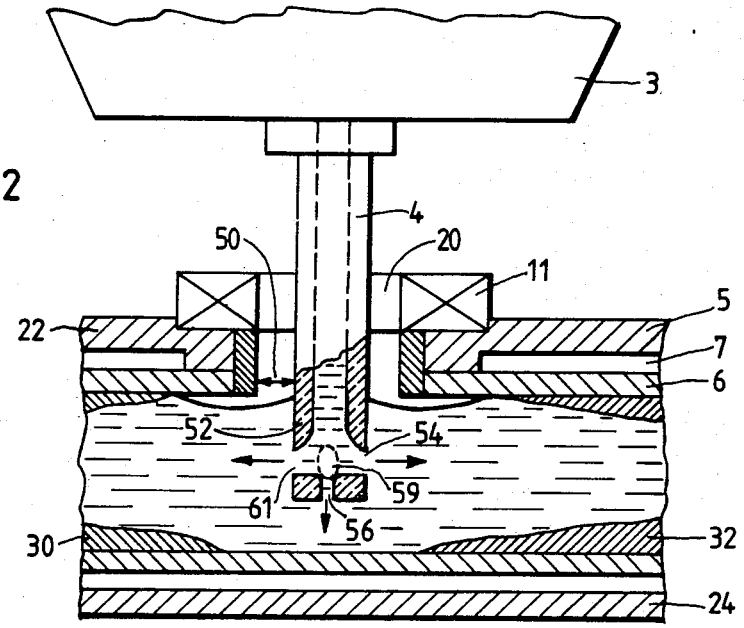
FIG. 2 illustrates details of the metal infeed arrangement of the continuous casting apparatus of FIG. 1, using an immersible refractory pouring tube between a supply vessel, such as a tundish, and the double-ended, oscillating, horizontal continuous casting mold equipped with an electromagnetic seal at the mold inlet opening.

Turning attention now to the drawings, it is to be understood that as a matter of convenience in illustration only enough of the construction of the continuous casting apparatus or machine has been shown as will enable those skilled in this art to readily understand the underlying principles and concepts of the present development. Additionally, throughout the various Figures there have been generally conveniently employed the same reference characters to denote the same or analogous components. Describing now the continuous casting apparatus or machine depicted in the drawings, the same may serve for the continuous casting of various types of strands, for instance billets, blooms or slabs. Solely for purposes of this disclosure it may be assumed that, the continuous casting apparatus of FIGS. 1 and 2 is used, for instance, for fabricating square billets of a dimension of, for example, 160 by 160 mm. As depicted therein, there is provided a supply vessel, such as a suitable casting ladle 1 from which issues a hot molten metal stream, especially steel, through a pouring tube 2 which then flows into a further supply vessel, here a tundish 3. The metal flow between the casting ladle 1 and the tundish 3 may be controlled by any suitable flow regulating means well known in the continuous casting art, such as for instance stoppers or slide-gates. This tundish 3 infeeds the molten metal contained therein through a ceramic immersible pouring tube 4 into a double-ended, cooled, oscillating, horizontal continuous casting mold 5. While the tundish 3 is shown distributing the liquid metal into a single continuous casting mold 5 it is to be understood that tundish 3 may supply molten metal to a plurality of horizontal casting molds.

Each such cooled continuous casting mold 5 comprises a horizontal straight mold formed by encircling mold walls 6 containing cooling slots 7 through which flows a suitable coolant, typically water. Mold 5 has a substantially vertical mold inlet or infeed opening 20, preferably located centrally at an upper mold wall, generally indicated by reference character 22. Through this mold inlet opening 20 there piercingly extends the immersible pouring tube 4 in a direction towards the lower mold wall, generally indicated by reference character 24, located opposite the upper mold wall 22. Furthermore, the horizontal straight cooled mold 5 contains two opposite hand cavities or mold compartments 26 and 28 in which there are simultaneously formed two cast strands 30 and 32, respectively. The continuous casting mold 5 is formed of a good thermally conductive material, such as by copper mold walls 6.

It will be seen by again reverting to FIG. 1 that the lateral mold inlet or inflow opening 20 is generally flush or coplanar with the upper mold wall 22. Moreover, the two mold compartments or cavities 26 and 28 are essentially coaxially arranged and extend substantially linearly with respect to one another towards the opposite open ends of the double-ended bidirectional continuous casting mold 5. This mold inlet or inflow opening 20 must be of a size not only adequate for piercingly receiving therethrough the immersible pouring tube 4, but to allow for the horizontal oscillation of the continuous casting mold 5 by any suitable mold oscillation assembly, generally designated by reference character 34 and which will be discussed more fully hereinafter.

The partially solidified strands 30 and 32 formed in the two mold compartments 26 and 28, respectively, are simultaneously bidirectionally withdrawn in opposite directions by means of suitable strand withdrawal devices, here simply shown as two respective pairs of, for instance, synchronized driven pinch rolls 9. If desired, the two withdrawal units constituted by the pinch rolls 9 can be operated at independent withdrawal speeds. Obviously, at the start of the continuous casting operation conventional dummy or starter bars are pluggingly inserted into the opposite open discharge ends of the continuous casting mold 5 for the purpose of initiating the casting operation and the withdrawal of the cast strands, as is likewise well known in the continuous casting art, and thus need not here be further considered.

Additionally, the cast strands 30 and 32 are horizontally guided, after they egress from the opposite open discharge ends of the continuous casting mold 5, by the strand guide arrangements or roller aprons 36 containing the support and guide rolls 38. Between the support and guide rolls 38 there may be provided any suitable secondary strand cooling means, here shown in the form of spray nozzles 40 for spraying a suitable cooling agent, typically water, onto the surfaces of the cast strands 30 and 32 in order to promote the solidification thereof in a manner also quite conventional in continuous casting. In the event that there are cast large blooms or slabs, instead of the billets, then the partially solidified strands would move essentially horizontally within suitable roll containment arrangements.

As stated, to prevent the continuously cast strands 30 and 32 from adhering to the inner walls of the continuous casting mold 5 there is provided the mold oscillation assembly or mechanism 34. Mold oscillation mechanisms suitable for the purposes of the invention are well known in the art, as exemplified for instance by the aforementioned U.S. Pat. No. 4,146,078 and U.S. Pat. No. 3,814,166, granted June 4, 1974. In the exemplary embodiment under discussion the mold oscillation assembly or mechanism 34 comprises a mold table 42 containing guide surfaces 43 upon which there are supported rollers 44 attached to the lower mold wall 24 of the continuous casting mold 5. For the purpose of properly oscillating the continuous casting mold 5 there is provided a suitable oscillating drive unit 46 composed of the lever arrangement 48 coacting with an eccentric drive 10, by means of which the continuous casting mold 5 can be reciprocatingly oscillated essentially horizontally in the direction of the double-headed arrow 55.

As already mentioned, since the mold 5 is oscillated back-and-forth in the explained manner the mold inlet or inflow opening 20 must be of a size sufficient to not only accommodate the immersible pouring tube 4 but to permit the oscillatory movement to be satisfactorily performed. The mold inlet opening 20 provided in the upper mold wall 22 therefore is dimensioned such that a spacing 50 is present between the inner boundary surface of the mold inlet opening 20 and the immersible pouring tube 4, viewed in the direction of oscillation of the continuous casting mold 5. The continuous casting mold 5 is therefore oscillated at an oscillating stroke which is smaller than this spacing 50 in the central position of the pouring tube 4 with respect to the mold inlet opening 20.

Since the mold inlet opening 20 is essentially flush with the upper mold wall 22, thereby providing a mold construction of particularly simple design because it does not contain at the region of such mold inlet opening any upstanding riser or reservoir region, provision must be made, however, to ensure that, during mold oscillation, the previously infed molten metal will not tend to splash out of such mold inlet opening 20. To that end there is provided an electromagnetic sealing device, here shown in the form of an electromagnetic or electrical coil arrangement 11 arranged coaxially above the mold inlet opening 20 and powered by any suitable power source, such as an alternating-current power source (not shown). Consequently, electromagnetic forces are generated by the electromagnetic coil arrangement 11 which act downwardly upon the surface or meniscus of the molten metal contained in the continuous casting mold 5, thereby preventing such from undesirably splashing out of the mold inlet opening 20.

The downwardly directed electromagnetic forces also tend to depress the molten metal beneath the mold inflow opening 20, and thus, there can be added at the metal pocket formed at this location, for instance either directly through the mold inlet opening 20 or with the aid of an appropriate infeed pipe or the like, suitable additives, such as lubricants, for instance casting powder, or any other desired materials, such as for example alloying additives. These downwardly directed electromagnetic forces also contribute to inhibiting the formation of a strand shell or skin at the interface region between the cast strands 30 and 32 beneath the mold inlet opening 20. As will be recalled, the formation of an interconnecting strand shell at such interface region is undesirable because the strand withdrawal operation exerts forces upon the cast strands which would then tend to unpredictably pull apart and rupture such interconnecting strand shell. Quite to the contrary, it is an important aspect of the invention to preclude or inhibit the formation of any interconnecting strand shell or skin at the interface region between the formed strands 30 and 32.

To that end, the pouring tube 4 extends sufficiently into the confines of the bidirectional continuous casting mold 5 and, specifically, towards the lower mold wall 24 so as to generate an imaginary common hot wall at the interface region between both of the continuously cast strands 30 and 32, i.e. at the direct inflow region of the molten metal into the mold 5. Such hot wall acts conjointly upon both of the continuously cast strands 30 and 32. The essentially most desirable position of the pouring tube 4 within the continuous casting mold 5, specifically the location of the discharge or outlet end region 52 thereof will depend upon various casting parameters, such as the temperature of the molten metal which is cast, the dimensions of the cast strand and so forth, and can be readily determined by trial and error. For instance, the discharge portion 52 of the immersible pouring tube 4, when casting slabs, normally will not be located above the longitudinal central axis of the continuous casting mold 5 and, to the extent needed, closer towards the bottom mold wall 24, i.e. below such longitudinal central axis. What is important is that the immersible pouring tube 4 be located within the continuous casting mold 5 such that the discharge portion 52 of the pouring tube 4 be positioned so as to effectively form the aforementioned common hot wall.

The pouring tube 4 is provided at its metal discharge portion or lower region 52 with a plurality of discharge or outlet openings 54 through which issues the molten metal supplied from the tundish 3. One of these discharge openings 56 may be directed downwardly towards the lower mold wall 24 and others may be directed laterally, as indicated by reference character 59 in FIG. 3, towards the narrow or upstanding side walls of the continuous casting mold 5. Still other discharge openings 61 may be directed, as shown in FIG. 1, in the direction of the lengthwise axis of the continuous casting mold 5.

By virtue of the arrangement of the pouring tube 4 in relation to the continuous casting mold 5 there is ensured for the formation of the common hot wall which advantageously precludes or inhibits the build-up of any undesirable strand shell or skin at the interface region between the formed cast strands 30 and 32. In this way there can be accomplished a simultaneous continuous withdrawal of both of the cast strands 30 and 32 from the continuous casting mold 5 in opposite directions without the one withdrawn strand adversely interfering with the other withdrawn strand since there is absent any shell interconnection between the two cast strands.

As already explained previously, the electromagnetic sealing device or electromagnetic coil 11 may contribute to inhibiting formation of the strand shell at the interface region, i.e. the region of the hot wall where the metal jets or streams issue from the lower discharge portion 52 of the pouring tube 4, due to the generation of the downwardly effective forces acting upon the meniscus of the molten metal located at the region of the mold inlet opening 20.

The effect of the electromagnetic coil 11 upon the meniscus of the liquid metal in the mold 5 has been shown on a somewhat exaggerated scale in the illustration of FIG. 2. Instead of, or in addition to the electromagnetic coil 11, there can be provided a pressurized flexible chamber located between the tundish 3 and the continuous casting mold 5 for exerting a downward force upon the molten metal level in the mold which counteracts the metallostatic or ferrostatic pressure. The force of the magnetic field or the pressure then can be automatically accommodated to the level of the molten metal in the tundish 3.

By virtue of the fact that the mold inlet opening 20 is essentially flush with the upper mold wall 22 and is essentially bounded solely by such upper mold wall 22, it is possible to place the tundish 3 closer towards the central lengthwise axis of the continuous casting mold 5 than would be otherwise the case when working with complicated constructions of continuous casting molds, such as those having upstanding reservoirs as previously taught to the art. Hence, there is a more direct and immediate transfer of metal between the tundish 3 and the mold cavities or compartments 26 and 28 of the continuous casting mold 5, with less heat losses. Furthermore, the metallostatic or ferrostatic pressure is lower, and hence, less demanding requirements are placed upon the electromagnetic seal 11 which therefore can be of simpler design.

Figure 2A:
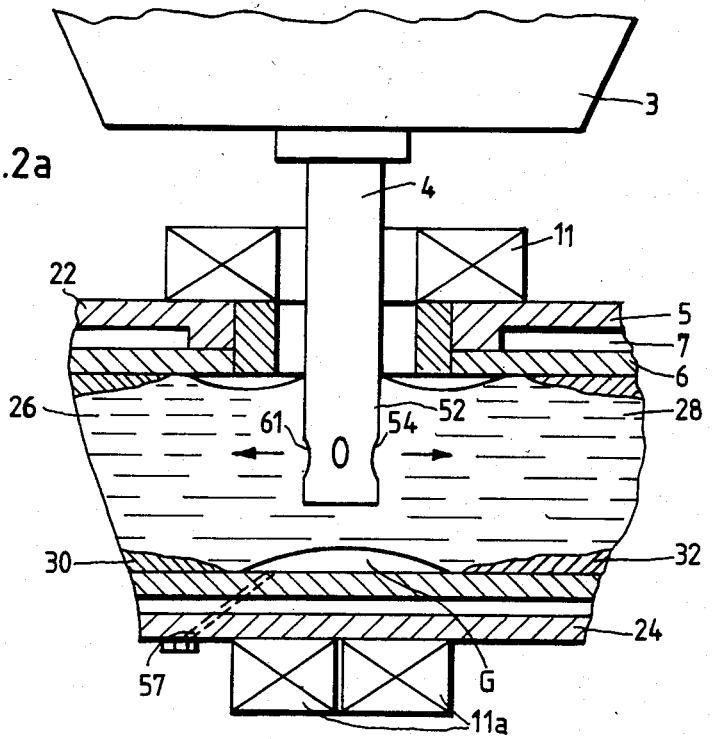
FIG. 2*a* is a modified arrangement from that shown in FIG. 2, wherein electromagnetic coil means serve to circumferentially lift-off the molten metal from the mold walls at a plane containing the pouring tube and where there is created the imaginary common hot wall.

With horizontally arranged continuous casting molds difficulties arise in introducing lubricants or other additives into the confines of the horizontal mold compartments, particularly in a manner such that such lubricants or additives are evenly distributed around the inner walls of the mold. In particular, lubricants, in conjunction with the oscillatory movement of the continuous casting mold, are used to prevent the strand from undesirably sticking to the inner walls of the mold. Therefore, in accordance with the modified construction of continuous casting machine as depicted in FIG. 2*a*, which constitutes a variant of the arrangement of FIGS. 1 and 2, and depending upon the size and shape of the cast strands, it is possible to provide additional electrical or electromagnetic coils 11*a* for generating magnetic fields which act as close as possible in the vertical plane of the imaginary hot wall. The magnetic fields which act around and towards the center of the cast strands maintain the just poured liquid steel afloat, thereby creating a gap G for the introduction of lubricants around all of the four walls of the mold, or in the case of a round sectional configuration of the cast strands, around the circumference of such cast strands.

Such lubricants or other appropriate additives, may be infed through the mold wall, for instance from below by means of a suitable infeed tube or pipe 57 as shown in FIG. 2*a*. The additional electromagnetic coil or coils 11*a* may be separate coils or, in fact, if desired the electromagnetic coil 11 can extend circumferentially completely about the continuous casting mold 5. Additionally, the action of the electromagnetic coil or coils 11 and 11*a*, as the case may be, causes lift-off of the molten metal at the region of the hot wall, and thus, contributes to preventing or inhibiting the formation of the undesired interconnecting strand shell between the two cast strands 30 and 32.

Figure 3:
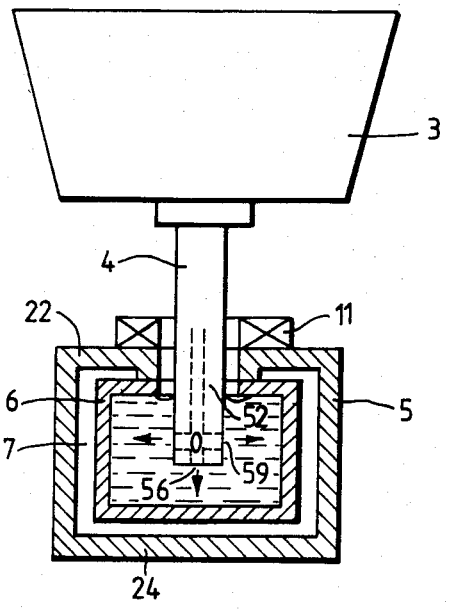
FIG. 3 is a schematic cross-sectional view of a horizontal continuous casting mold used for forming billets and blooms.

FIG. 3 illustrates a cross-section of a continuous casting mold 5 useful for the casting of billets and blooms, which may be of square or rectangular cross-sectional configuration. Here, the immersible pouring tube 4 is provided at its discharge portion 52 with the laterally directed outlet or discharge openings 59 which extend towards the narrow sides of the continuous casting mold 5, and thus, act thereat to prevent the formation of the undesired interconnecting strand shell. Also, the downwardly directed pouring tube opening 56 causes hot metal to issue from the lower end of the pouring tube 4 towards the bottom mold wall 24.

Figure 4:
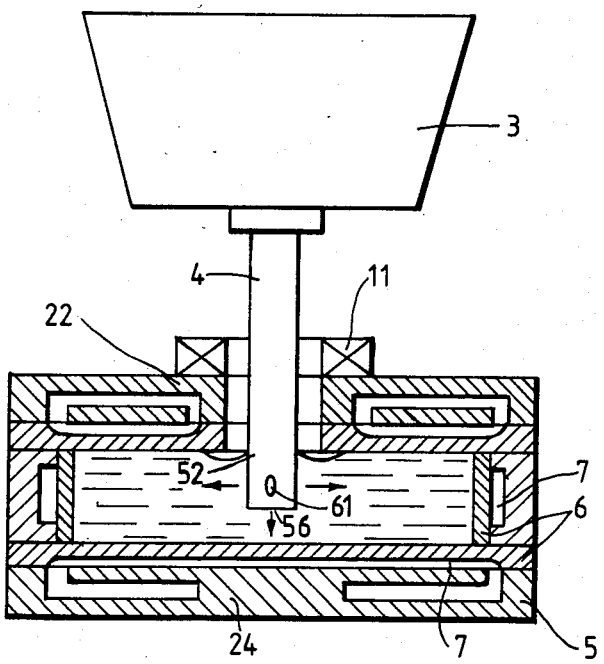
FIG. 4 is a cross-sectional view of a horizontal continuous casting mold for casting rectangular blooms or slabs in accordance with the invention.

FIG. 4 is essentially a cross-sectional view of a somewhat modified form of continuous casting mold 5, from the arrangement of FIG. 3, used for casting rectangular blooms or slabs. Again, the immersible pouring tube 4 is provided at its discharge end or portion 52 with the laterally extending exit or discharge openings 59 for the metal jets and the downwardly extending discharge opening 56 directed towards the bottom mold wall 24. Additional discharge openings 61 may be provided which extend in the lengthwise direction of the mold 5.

Figure 5:
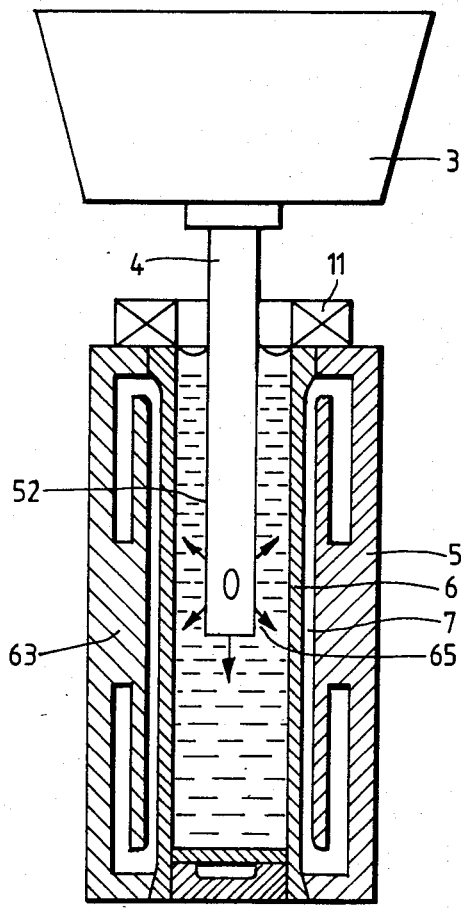
FIG. 5 is a cross-sectional view through a horizontal continuous casting mold for casting slabs or blooms with the wide mold walls located in a vertical plane.

FIG. 5 depicts a cross-sectional view through a bidirectional continuous casting mold for casting slabs or blooms wherein the wide walls 63 of the mold are located in essentially vertical planes. The immersible pouring tube 4 is provided at its discharge end portion or region 52 with a plurality of discharge openings 65 which direct the issuing hot metal jets at an inclination with respect to the horizontal upwardly and downwardly towards the wide sides of the cast strands. Also, at the lower end of the pouring tube 4 there is provided the discharge or outlet opening 56 which downwardly directs a jet of the molten metal towards the narrow side of the cast strand located at the bottom of the continuous casting mold 5. In all other respects this arrangement is quite similar to that previously discussed with respect to FIGS. 1 to 4.

Figure 7:
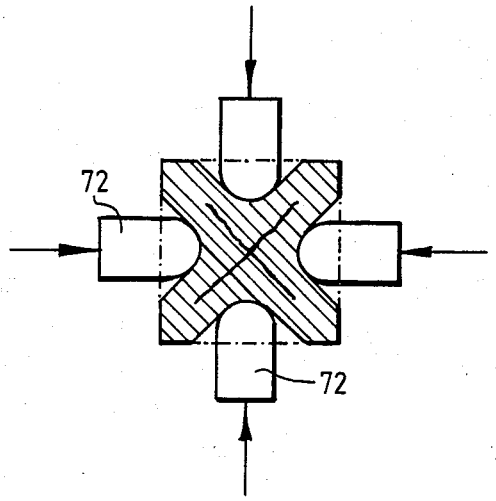
FIG. 7 is an enlarged detail view, shown from the side, of an anvil or plunger-type shut-off device for eliminating metal break-out by acting upon all four sides or walls of the cast strand.
Figure 6:
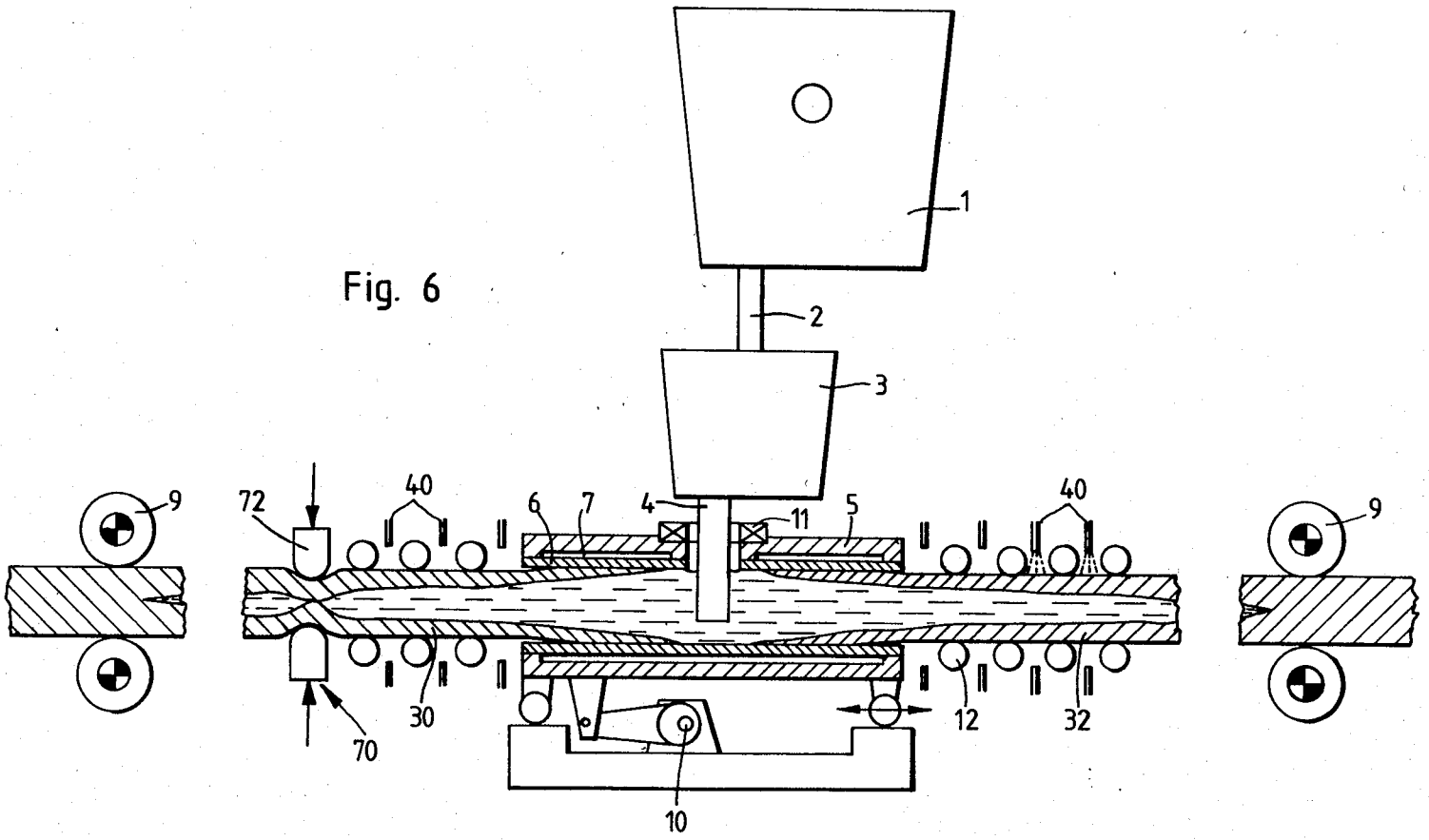
FIG. 6 is a schematic elevational view, similar to the arrangement of FIG. 1, but showing the use of an anvil or plunger-type shut-off device for counteracting metal break-outs.

FIGS. 6 and 7 illustrate a modified construction of continuous casting machine, FIG. 6 being an elevational longitudinal view essentially corresponding to the arrangement of FIG. 1, but equipped with a shut-off device for counteracting any undesirably occurring metal break-out phenomenon, and FIG. 7 illustrating details of the shut-off device depicted in FIG. 6. As is well known in the continuous casting art upon the occurrence of metal break-out it is desirable to shut-down the further production of the cast strand where such metal break-out has occurred as quickly as possible in order to reduce the amount of lost liquid metal. Therefore, in the arrangement of FIG. 6 there is disclosed a shut-off device 70 which is located, for instance, between the strand guide and support rolls 12 and the driven withdrawal or pinch rolls 9 for the strand 30. This shut-off device 70 may be activated in response to any suitable metal break-out detector conventionally employed in the continuous casting art. Such shut-off device 70 will be seen to comprise four anvils or plungers 72, as best recognized by referring to FIG. 7, which act upon all four sides of the cast strand. Should break-out occur the anvils 72 or equivalent structure are moved inwardly towards the central axis of the cast strand, exerting a pinching action on the respective oppositely located strand walls, and therefore fusing or welding together the solidified walls of the cast strand 30 to prevent any outflow of the still liquid metal core or pool within such cast strand. A similar type of shut-off device 70 would be provided, of course, at the opposite end of the bidirectional continuous casting mold for the other cast strand 32. It is not absolutely necessary, however, that the anvils or plungers 72 act upon all four sides of the strand walls, and it is conceivable to use only two such anvils or plungers 72 which press against two opposite sides of the strand walls for the purpose of fusing or welding shut the defective strand to prevent further escape of metal from the liquid core or pool thereof.

Additionally, there may be provided a not particularly illustrated spraying system and a water-filled trough with the purpose of granulating the liquid metal escaping from metal break-outs.

Figures 8, 8A:
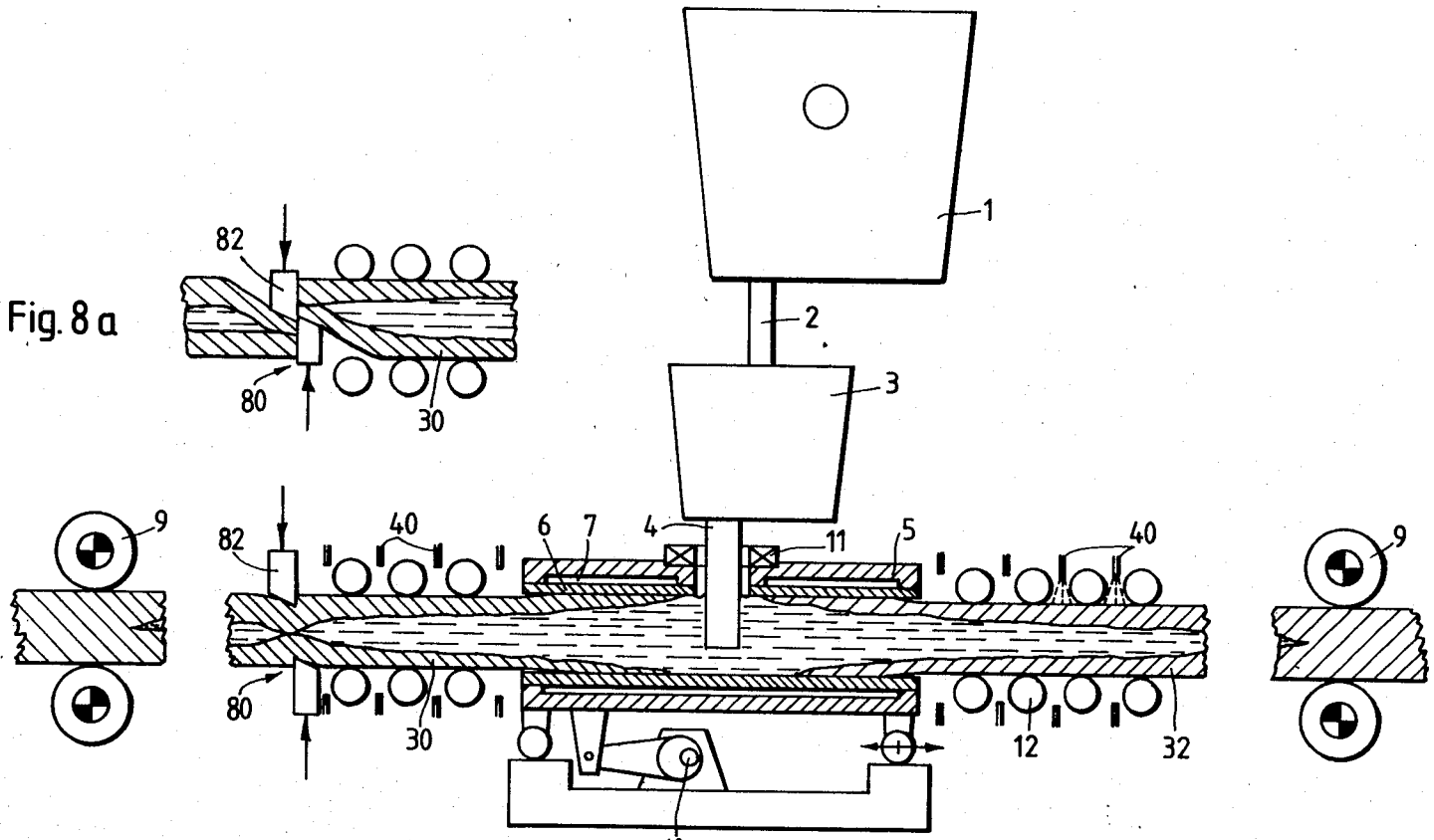
FIG. 8 is a schematic elevational view, again like the showing of FIG. 1, but depicting a modified construction of blade-type metal shut-off device where there is fused shut and sheared the strand after metal break-out has occurred.
FIG. 8*a* illustrates the arrangement of FIG. 8 during fusing and shearing of the strand.

A still further possible construction of shut-off device 80 has been depicted in FIGS. 8 and 8*a* wherein, here, there are employed two coacting plunger-like cutters or blades 82 which move towards the lengthwise axis of the related strand when metal break-out occurs. These blades 82 act upon the opposed, for instance upper and lower walls of the cast strand, as particularly well shown in FIGS. 8 and 8*a*, thus initially urging them together, then fusing such strand walls to one another, whereafter the blades 82 then sever-off the leading or downstream portion of the cast strand from the fused shut-off end of the cast strand emerging from the continuous casting mold, in order to thus effectively confine the still liquid metal pool contained in the downstream portion of the cast strand.

Figure 9:
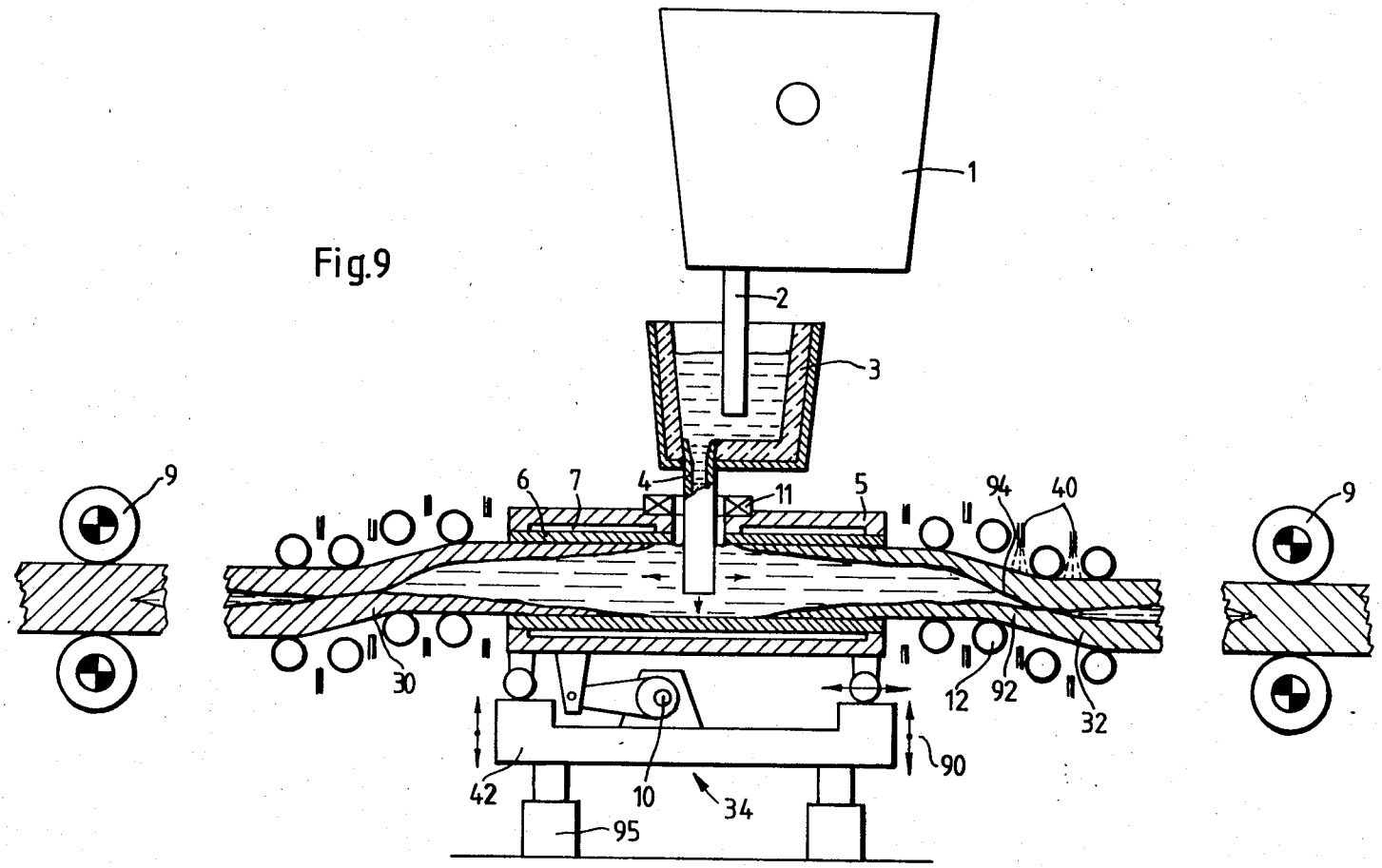
FIG. 9 is a view, again similar to the arrangement of FIG. 1, but depicting a shut-off mechanism which accomplishes the metal shut-off operation by lifting the mold oscillating assembly and part of the strand guide arrangement and secondary cooling.

Yet another possibility of constructing the shut-off device has been depicted in FIG. 9 wherein the mold oscillating assembly 34 can be lifted in the direction of the tundish 3 as indicated by the double-headed arrows 90. By so doing the roll aprons or strand guides containing the rolls 12 situated closer to the open discharge ends of the double-ended continuous casting mold 5 together with the related spray nozzles 40 of such secondary cooling are raised, whereby the lower wall 92 of each of the cast strands 30 and 32 is urged towards the upper wall 94 thereof, with the result that again the leading ends of the cast strands 30 and 32 emerging from the double-ended continuous casting mold 5 are positively fused shut. The vertical lift of the mold assembly and portions of the roller aprons and secondary cooling must be great enough to prevent the flow of liquid metal from one side to the other and to effectively seal the opposite ends of the emerging cast strands, as shown in FIG. 9. Lifting of the mold assembly and neighboring roller aprons and secondary cooling can be accomplished, for instance, by appropriately raising the mold table 42 and related structure supported thereon in the direction of the tundish 3 by means of any suitable standard power applying devices, such as fluid-operated piston-and-cylinder units or other appropriate drives, merely schematically indicated by reference numeral 95. The mold table 42 and the structure supported thereon is raised towards the tundish 3 through a height equal to or greater than the diameter of the strand.

Figure 10:
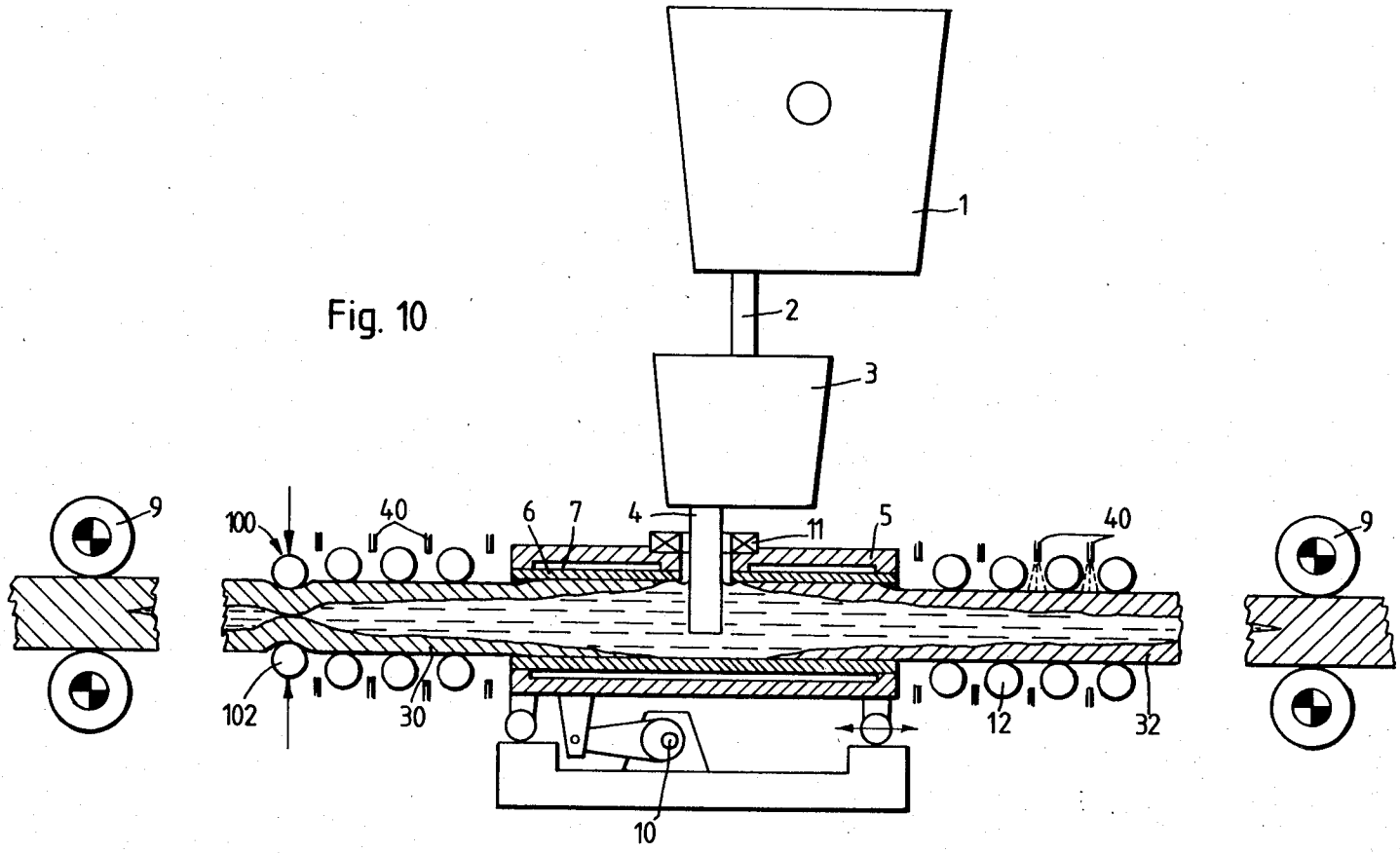
FIG. 10 illustrates a continuous casting arrangement, once again similar to the showing of FIG. 1, wherein there are employed pinch rolls pressing against the strand in order to counteract any metal break-out.

Finally, in FIG. 10 there is depicted a still further construction of shut-off device 100 for counteracting the undesirable effects of metal break-out. Here there are used oppositely situated pinch rolls 102 which act upon opposite sides of the cast strand 30, thereby squeezing together, for instance, the upper and lower strand walls and fusing shut the emerging end of the cast strand. In all of the arrangements of shut-off devices herein disclosed it is believed to be readily evident that both sides of the continuous casting mold 5 would be provided with a related shut-off device for each emerging cast strand.

While there are shown and described present preferred embodiments of the invention, it is to be distinctly understood that the invention is not limited thereto, but may be otherwise variously embodied and practiced within the scope of the following claims. Accordingly,

What I claim is:

1. A horizontal continuous casting method for bidirectionally casting strands comprising the steps of:

downwardly introducing molten metal through a mold inlet opening into a direct inflow region of a double-ended horizontal oscillating continuous casting mold;

preventing the formation of a strand shell along walls of the continuous casting mold at said direct inflow region of the molten metal in the continuous casting mold;

bidirectionally feeding the molten metal from said direct inflow region into two oppositely extending cavities of said mold;

cooling the infed molten metal and simultaneously forming the infed molten metal into two strands in said two cavities of said mold; and horizontally conveying said two strands in two opposite directions out of said continuously casting mold while oscillating said continuous casting mold.

2. The horizontal continuous casting method as defined in claim 1, further including the step of:

generating forces at the direct inflow region of the molten metal into the continuous casting mold which act from above and counteract ferrostatic pressure of the infed molten metal and which forces depress the infed molten metal within the continuous casting mold.

3. The horizontal continuous casting method as defined in claim 2, further including the step of:

utilizing electromagnetic coil means for generating said forces.

4. The horizontal continuous casting method as defined in claim 2, further including the step of:

adding at least one additive to the depressed molten metal.

5. The horizontal continuous casting method as defined in claim 1, further including the step of:

upon occurrence of metal break-out raising the continuous casting mold as well as directly thereat neighboring parts of a strand guide and secondary cooling arrangement until opposite walls of the continuously cast strands come into contact with one another.

6. The horizontal continuous casting method as defined in claim 1, further including the steps of:

upon occurrence of metal break-out pressing at least two oppositely situated sides of the strand against one another.

7. The method as defined in claim 1, wherein:

the step of downwardly introducing molten metal through the mold inlet opening into the direct inflow region of the double-ended horizontal oscillating continuous casting mold entails the step of introducing the molten metal into a substantially central portion of the mold located between the ends of the mold.

8. A horizontal continuous casting method for bidirectionally casting strands comprising the steps of:

substantially vertically introducing molten metal through a mold-inlet opening into a direct inflow region of a double-ended horizontal oscillating continuous casting mold;

bidirectionally feeding the molten metal from said direct inflow region into two oppositely extending cavities of said mold;

cooling and simultaneously forming the infed molten metal into two continuously cast strands in the two cavities of said mold;

formation of the continuously cast strands being accomplished by acting at an interface between the two cast strands in said direct inflow region such that there is formed a hot wall which precludes the formation of a strand shell at said interface which otherwise would interconnect the two cast strands;

formation of the two cast strands further being accomplished by exerting upon a liquid metal meniscus in said direct inflow region of the continuous casting mold a force which prevents outflow of the molten metal from the mold inlet opening of the continuous casting mold;

conveying said strands substantially horizontally in two opposite directions while oscillating said continuous casting mold; and cooling the continuously cast strands emerging from the continuous casting mold.

9. The horizontal continuous casting method as defined in claim 8, including the step of:

acting upon at least the liquid metal meniscus in the continuous casting mold with a force sufficient to not only prevent escape of the molten metal through an inlet opening of the continuous casting mold but also to prevent the formation of any interconnecting strand shell at the region of the hot wall.

10. The continuous casting method as defined in claim 8, further including the steps of:

applying electromagnetic forces upon at least predetermined portions of the molten metal at said interface in order to lift-off predetermined portions of the molten metal from the mold walls in order to form at least one gap; and introducing a lubricant into said at least one gap.

11. The horizontal continuous casting method as defined in claim 8, further including the steps of:

applying an inert gas to the molten metal at the region of a mold inlet opening of the continuous casting mold, in order to form a pressurized closed shroud acting upon said molten metal so as to counteract the metallostatic pressure of the molten metal contained within the continuous casting mold.

12. The horizontal continuous casting method as defined in claim 8, further including the step of:

using an immersible pouring tube for vertically introducing the molten metal into the continuous casting mold.

13. The horizontal continuous casting method as defined in claim 12, including the step of:

using as said immersible pouring tube a pouring tube having at least one discharge opening for the molten metal which is directed at least towards a lower wall of the continuous casting mold.

14. The horizontal continuous casting method as defined in claim 12, further including the steps of:

positioning the pouring tube such that a discharge portion thereof does not extend essentially above a longitudinal central axis of the continuous casting mold.

15. The continuous casting method as defined in claim 12, wherein:

the pouring tube has a discharge portion located closer to a lower mold wall than an upper mold wall.

16. The horizontal continuous casting method as defined in claim 8, further including the step of:

generating electromagnetic forces acting upon the molten metal in the continuous casting mold such as to constrict the molten metal at said interface in order to lift the molten metal away from predetermined wall means of the continuous casing mold to aid in preventing the formation of the strand shell at said interface.

17. The continuous casting method as defined in claim 16, wherein:

said electromagnetic forces are generated by the same means used for preventing the outflow of molten metal from the continuous casting mold.

18. The horizontal continuous casting method as defined in claim 8, further including the step of:

using a continuous casting mold having a mold inlet opening which is substantially flush with an upper mold wall.

19. The continuous casting method as defined in claim 18, further including the steps of:

infeeding the molten metal from a tundish with which there is connected an immersible pouring tube; and positioning said tundish in close proximity to the mold inlet opening of the continuous casting mold.

20. The continuous casting method as defined in claim 7, further including the steps of:

shutting-off the outflow of molten metal in the event of metal break-out by acting upon at least two opposed sides of the continuously cast strand where metal break-out has occurred.

21. The continuous casting method as defined in claim 20, wherein:

the step of acting upon at least two opposed sides of the continuously cast strand is accomplished by raising at least parts of a strand guide and secondary cooling for the cast strand where metal break-out has occurred until contact of oppositely situated sides of such cast strand.

22. A horizontal continuous casting method for bidirectionally casting strands comprising the steps of:

downwardly introducing a molten metal stream into a double-ended, horizontal, cooled oscillating continuous casting mold;

cooling and simultaneously forming the molten metal into two strands;

the step of simultaneously forming the molten metal into two strands contemplates infeeding the molten metal by means of a pouring tube into the continuous casting mold through a mold inlet opening in a manner such that the pouring tube forms an imaginary hot wall at a direct inflow region of the molten metal into the continuous casting mold which precludes the formation of a strand shell at an interface between the two continuously cast strands and further contemplates bidirectionally feeding the molten metal from said direct inflow region into two oppositely extending cavities of said mold; and substantially horizontally conveying said two strands in two opposite directions out of said continuously casting mold while oscillating said continuous casting mold.

23. A horizontal continuous casting method for bidirectionally casting strands comprising the steps of:

downwardly introducing a molten metal stream through a mold inlet opening into a direct inflow region of a double-ended, horizontal, cooled continuous casting mold;

cooling and simultaneously forming the molten metal into two independent strands within the continuous casting mold;

said step of simultaneously forming the molten metal into two independent strands comprises generating electromagnetic forces at an outer surface of the molten metal located substantially in a plane defined by said direct inflow region of the molten metal into the continuous casting mold, in order to inhibit the formation of an interconnecting strand shell at said direct inflow region by forcing the molten metal away from the walls of the continuous casting mold; and conveying said two strands substantially horizontally in two opposite directions while oscillating said continuous casting mold.

24. A continuous casting apparatus for bidirectionally casting strands, comprising:

a substantially straight horizontal continuous casting mold having a mold inlet opening for receiving molten metal and two opposite hand cavities within which there are simultaneously formed two strands;

an electromagnetic coil for generating a magnetic field acting upon a liquid metal meniscus in the continuous casting mold at the region of the mold inlet opening for counteracting the metallostatic pressure within the continuous casting mold;

a pouring tube for infeeding the molten metal through the mold inlet opening and coacting with the mold cavities in a manner such as to create a common imaginary hot wall conjointly effective at an interface region between both of the continuously cast strands formed in the continuous casting mold in order to preclude the formation of a strand shell at said interface region so as to facilitate withdrawal of both strands independently of one another from the continuous casting mold; and means for substantially horizontally oscillating said continuous casting mold.

25. The apparatus as defined in claim 24, further including:

means for withdrawing the cast strands from opposed ends of said continuous casting mold.

26. The apparatus as defined in claim 24, wherein:

said pouring tube has at least one discharge opening directed at least towards a lower portion of the continuous casting mold.

27. The apparatus as defined in claim 24, wherein:
said pouring tube has a discharge portion containing outlet opening means for the molten metal; and
said discharge portion being located closer to a lower wall than an upper wall of said continuous casting mold.

28. The continuous casting apparatus as defined in claim 24, further including:
means for exerting an electromagnetic force upon an outer surface of the molten metal at a region located in a plane containing the pouring tube so as to constrict the molten metal to prevent contact thereof with the walls of the continuous casting mold, in order to thereby preclude the formation of a strand shell interconnecting the two continuously cast strands.

29. The continuous casting apparatus as defined in claim 24, further including:
means for introducing a casting powder into the continuous casting mold at the region of the interface between the two continuously cast strands.

30. The continuous casting apparatus as defined in claim 24, wherein:
said oscillating means oscillate said continuous casting mold at a stroke which is less than the spacing between the outer surface of the pouring tube and the wall of the continuous casting mold bounding such mold inlet opening.

31. The continuous casting apparatus as defined in claim 24, wherein:
said substantially straight horizontal continuous casting mold constitutes an essentially one-piece mold.

32. The continuous casting apparatus as defined in claim 24, further including:
shut-off means provided for said continuously cast strands for shutting-off the outflow of liquid metal from at least one of said cast strands where there has occurred metal break-out.

33. The continuous casting apparatus as defined in claim 32, wherein:
said shut-off means comprise at least two anvils pressing against opposite side walls of the strand where metal break-out has occurred.

34. The continuous casting apparatus as defined in claim 32, wherein:
said shut-off means comprise four anvils pressing against all four sides of the strand walls of the strand where there has occurred metal break-out.

35. The continuous casting apparatus as defined in claim 32, further including:
roller aprons for supporting and guiding the strands emerging from the continuous casting mold; and
said shut-off means comprises structure for lifting the continuous casting mold along with predetermined ones of said roller aprons in order to weld together upper and lower walls of the continuously cast strand at which metal break-out has occurred.

36. The continuous casting apparatus as defined in claim 32, wherein:
said shut-off means comprises pinch rolls acting upon the continuously cast strand at which metal break-out has occurred.

37. The continuous casting apparatus as defined in claim 32, wherein:
said shut-off means comprise at least two coacting blades for welding shut opposite walls of the cast strand where there has occurred metal break-out.

38. The continuous casting apparatus as defined in claim 37, wherein:
said two blades coact with one another and move towards the center of the strand such that they sever-off the strand emerging from the continous casting mold from the remaining portion of the previously cast strand.

39. A continuous casting apparatus for bidirectionally casting strands, comprising:
a double-ended horizontal, cooled oscillating continuous casting mold having a mold inlet opening for receiving molten metal and two cavities within which there are simultaneously formed two continuously cast strands;
means for infeeding molten metal through the mold inlet opening into said two cavities;
means for preventing at a direct inflow region of the molten metal into the mold the formation of a strand shell along walls of said mold and which strand shell otherwise would interconnect said two strands;
means for substantially horizontally oscillating said continuous casting mold; and
means for withdrawing the cast strands from opposed ends of said continuous casting mold.

40. The continuous casting apparatus as defined in claim 39, wherein:
said means for preventing the formation of said strand shell comprises said pouring tube being positioned in the mold inlet opening and within the mold cavities such that the molten metal directly outflowing from said pouring tube forms an imaginary hot wall which counteracts the formation of said strand shell.

41. The continuous casting apparatus as defined in claim 39, wherein:
said means for preventing the formation of the strand shell comprises electromagnetic means exerting a constricting force upon the molten metal at the direct inflow region of said molten metal into the mold to prevent the formation of said strand shell.

* * * * *

UNITED STATES PATENT AND TRADEMARK OFFICE

CERTIFICATE OF CORRECTION

PATENT NO. : 4,540,037

DATED : September 10, 1985

INVENTOR(S) : CARL LANGNER

It is certified that error appears in the above—identified patent and that said Letters Patent is hereby corrected as shown below:

Item [73] Assignee:, please delete "Concast AG, Zurich, Switzerland" and insert --S.M.S. Concast Inc. --.

Item [54], line 3 of the title, please delete "CASING" and insert --CASTING--

Signed and Sealed this

*Twenty-eighth* Day of *January 1986*

[SEAL]

*Attest:*

DONALD J. QUIGG

*Attesting Officer*

*Commissioner of Patents and Trademarks*